United States Patent [19]

Abkowitz et al.

[11] Patent Number: 4,987,033

[45] Date of Patent: Jan. 22, 1991

[54] IMPACT RESISTANT CLAD COMPOSITE ARMOR AND METHOD FOR FORMING SUCH ARMOR

[75] Inventors: Stanley Abkowitz, Lexington; David M. Rowell, Billerica; Harold L. Heussi, Essex; Harold P. Ludwig, Woburn; Stephen A. Kraus, Clinton, all of Mass.

[73] Assignee: Dynamet Technology, Inc., Burlington, Mass.

[21] Appl. No.: 286,940

[22] Filed: Dec. 20, 1988

[51] Int. Cl.[5] ..... B32B 7/02

[52] U.S. Cl. ..... 428/469; 428/472.2; 428/911; 419/8; 419/12; 419/14; 419/19; 419/42; 419/49; 419/68; 2/2.5; 89/36.02

[58] Field of Search ..... 89/36.02; 419/8, 12, 419/14, 19, 42, 68, 49; 2/2.5; 428/472.2, 469, 704, 911, 378, 389

[56] References Cited

U.S. PATENT DOCUMENTS

| | | | |
|---|---|---|---|
| H000,343 | 10/1987 | Keown et al. | 102/517 |
| 3,361,562 | 1/1968 | Ulrich et al. | 419/8 |
| 3,492,120 | 1/1970 | Haller . | |
| 4,030,427 | 6/1977 | Goldstein | 109/82 |
| 4,090,873 | 5/1978 | Takamura et al. | 419/8 |
| 4,492,737 | 1/1985 | Conolly | 428/552 |
| 4,643,648 | 2/1987 | Huller | 416/241 B |
| 4,719,151 | 1/1988 | Chyung et al. | 428/428 |
| 4,760,611 | 8/1988 | Huet et al. | 2/2.25 |
| 4,861,546 | 8/1989 | Friedman | 419/8 |
| 4,876,941 | 10/1989 | Barnes et al. | 89/36.02 |

*Primary Examiner*—Brooks H. Hunt
*Assistant Examiner*—Ngoclan Mai
*Attorney, Agent, or Firm*—Finnegan, Henderson, Farabow, Garrett & Dunner

[57] ABSTRACT

Impact resistant clad composite armor and method for forming such armor. The impact resistant clad composite armor includes a ceramic core, and a layer of metal surrounding the ceramic material and bonded to the ceramic core. The metal layer is formed by cold isostatically pressing powder metal surrounding the ceramic core to a high initial density followed by vacuum sintering. The composite armor may be hot isostatically pressed to densify the powder metal to approximately 99% full density.

16 Claims, 1 Drawing Sheet

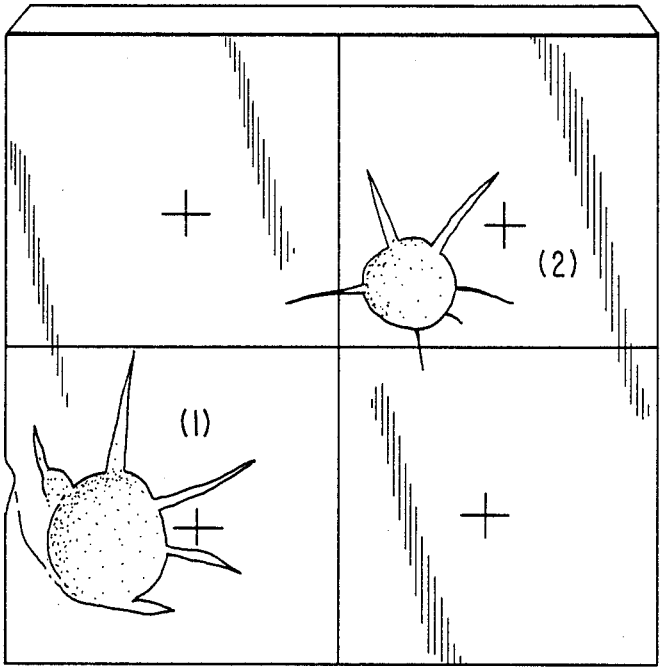
(2)
(1)

IMPACT RESISTANT CLAD COMPOSITE ARMOR AND METHOD FOR FORMING SUCH ARMOR

FIELD OF THE INVENTION

The present invention relates to the cladding of metallic and ceramic materials and, more particularly, to an impact resistant clad composite armor and method for forming such armor.

BACKGROUND OF THE INVENTION

Ceramic materials have been considered for use in the fabrication of armor components because they have high hardness capable of withstanding armor piercing projectiles and are relatively lightweight. The use of ceramic materials in armor applications, however, is limited by the low impact resistance of these materials caused by brittleness and lack of toughness. One of the significant drawbacks to the use of ceramic materials in armor applications is that they lack repeat hit capability. In other words, ceramic materials tend to disintegrate when subjected to multiple projectiles. To successfully utilize ceramic materials in armor applications, it is necessary to improve the impact resistance of this class of materials.

Accordingly, it is an object of the invention to provide an armor component formed of a ceramic material that has improved impact resistance.

It is a further object of the invention to provide a method for forming an armor component from a ceramic material that has improved impact resistance.

Additional objects and advantages will be set forth in part in the description which follows, and in part will be obvious from the description or may be learned by practice of the invention.

SUMMARY OF THE INVENTION

To achieve the foregoing objects and in accordance with the purpose of the invention, as embodied and broadly described herein, the impact resistant clad composite armor of the present invention includes a ceramic core, and a layer of metal surrounding the ceramic core and bonded to the ceramic core. In accordance with the method for forming an impact resistant clad composite armor having a ceramic core of the present invention, the layer of metal is formed by cold isostatically pressing powder metal surrounding the ceramic core to a high initial density to form an armor compact. The armor compact is vacuum sintered to further densify the powder metal and form the composite armor. If desired, the armor may be hot isostatically pressed to densify the powder metal to approximately 99% full density.

The ceramic core is preferably a ceramic material selected from the group consisting of $Al_2O_3$, $B_4C$, and $TiB_2$. The powder metal used to form the metal layer is preferably selected from the group consisting of aluminum alloys, commercially pure titanium, and titanium alloys. The combination of commercially pure titanium or Ti-6Al-4V clad on a $TiB_2$ ceramic core is particularly advantageous because the diffusion at the metal/-ceramic interface provides a chemical bond that enchances the physical characteristics of the resulting composite.

The accompanying drawing, which is incorporated in and constitutes a part of the specification, illustrates an embodiment of the invention and, together with the description, serves to explain the principles of the invention.

BRIEF DESCRIPTION OF THE DRAWINGS

The sole FIGURE is a composite armor plate of the invention having 6061 aluminum alloy clad on an $Al_2O_3$ core.

DESCRIPTION OF THE PREFERRED EMBODIMENTS

Reference will now be made in detail to the presently preferred embodiments of the invention, an example of which is illustrated in the accompanying drawing.

A ceramic core having the shape of the desired armor component is provided. The ceramic core preferably is comprised of a ceramic material selected from the group consisting of $Al_2O_3$, $B_4C$, and $TiB_2$. Practice of the invention is not limited to these preferred ceramic materials, however, because the principles of the invention are applicable to any ceramic material having high hardness but low impact resistance.

In accordance with the invention, the ceramic core is surrounded with powder metal. The powder metal may be disposed so as to surround the ceramic core in a suitable mold. The powder metal is preferably disposed to surround the ceramic core uniformly so that a layer having uniform thickness will be formed upon compaction of the powder metal. The amount of powder metal disposed around the ceramic core may be varied depending on the desired thickness of the layer.

While the powder metal may be any ductile metal or alloy, it is preferred that the powder metal is a relatively lightweight metal or alloy so that the advantages of the lightweight ceramic core can be maintained. The powder metal preferably is selected from the group consisting of aluminum alloys, commercially pure titanium, and titanium alloys.

In accordance with the invention, the powder metals surrounding the ceramic core is cold isostatically pressed to a high initial density (typically 85% full density) to form an armor compact. The cold isostatic pressing step ensures uniform clad density and eliminates thermal stress generation within the ceramic core.

In accordance with the invention, the armor compact is vacuum sintered to further densify the powder metal (typically to 95% full density) and form the composite armor. If desired, the composite armor may be hot isostatically pressed to densify the powder metal to approximately 99% full density.

The principles of the present invention described broadly above will now be described with reference to specific examples.

EXAMPLE I

A 6061 aluminum alloy was clad on an $Al_2O_3$ core to form composite armor plates having dimensions of 2 inches by 2 inches by 0.375 inch and 6 inches by 6 inches by 1 inch. Powder 6061 aluminum alloy surrounding the $Al_2O_3$ core was cold isostatically pressed at 55 ksi, vacuum sintered in an atmosphere of $10^{-1}$ torr at 1050° F. for one hour, and hot isostatically pressed at 15 ksi and 970° F. for two hours.

EXAMPLE II

A 6061 aluminum alloy was clad on a $B_4C$ core to form composite armor plates having the dimensions recited in Example I. The processing parameters were the same as recited in Example I.

EXAMPLE III

A 6061 aluminum alloy was clad on a $TiB_2$ core to form composite armor plates having the dimensions recited in Example I. The processing parameters were the same as recited in Example I.

EXAMPLE IV

Commercially pure titanium was clad on a $Al_2O_3$ core to form composite armor plates having the dimensions recited in Example I. Powder commercially pure titanium surrounding the $Al_2O_3$ core was cold isostatically pressed at 55 ksi, vacuum sintered in an atmosphere of $10^{-5}$ torr at 2200° F. for two hours, and hot isostatically pressed at 15 ksi and 1650° F. for two hours.

EXAMPLE V

Commercially pure titanium was clad on a $B_4C$ core to form composite armor plates having the dimensions recited in Example I. The processing parameters were the same as recited in Example IV.

EXAMPLE VI

Commercially pure titanium was clad on a $TiB_2$ core to form composite armor plates having the dimensions recited in Example I. The processing parameters were the same as recited in Example IV.

EXAMPLE VII

Ti-6Al-4V alloy was clad on an $Al_2O_3$ core to form composite armor plates having the dimensions recited in Example I. The processing parameters were the same as recited in Example IV.

EXAMPLE VIII

Ti-6Al-4V alloy was clad on a $B_4C$ core to form composite armor plates having the dimensions recited in Example I. The processing conditions were the same as recited in Example IV.

EXAMPLE IX

Ti-6Al-4V alloy was clad on a $TiB_2$ core to form composite armor plates having the dimensions recited in Example I. The processing parameters were the same as recited in Example IV.

Analysis of Examples I–IX revealed two types of bonding conditions at the metal/ceramic interface. In Examples I–V, VII, and VIII, no significant chemical interaction was observed at the metal/ceramic interface. The bonding in these examples is essentially mechanical in nature and the impact resistance of the resultant composite is directly related to the strength and ductility of the metal clad on the ceramic core.

In Examples VI and IX, where commercially pure titanium and Ti-6Al-4V alloy, respectively, were clad on a $TiB_2$ core, significant chemical bonding was observed at the metal/ceramic interface. In ballistic testing, test plates formed from these material combinations were superior in impact resistance to unclad $TiB_2$ test plates and demonstrated repeat hit capability. It is believed that as a result of the chemical bonding at the metal/ceramic interface, any loads or impacts applied to the resultant composite are absorbed by both the metal and the ceramic in accordance with the relative amounts of these materials in the composite.

The sole FIGURE is a composite armor plate of the invention having 6061 aluminum alloy clad on an $Al_2O_3$ core. This composite armor plate was subjected to ballistic testing with a first projectile impacting the plate in the upper right hand quadrant and a second projectile impacting it in the lower left hand quadrant. As can be seen in the sole FIGURE, the composite armor plate withstood the impact of the multiple projectiles without disintegrating thus demonstrating the repeat hit capability of the composite armor plate of the invention.

The present invention has been disclosed in terms of preferred embodiments. The invention is not limited thereto and is defined by the appended claims and their equivalents.

What is claimed is:

1. A method for forming an impact resistant clad composite armor having a ceramic core, said method comprising the steps of:

surrounding said ceramic core with powder metal;

cold isostatically pressing the powder metal surrounding said ceramic core to a high initial density to form an armor compact; and vacuum sintering said armor compact to further densify the powder metal and form said composite armor.

2. The method of claim 1, further comprising the step of:

hot isostatically pressing said armor to densify the powder metal to approximately 99% full density.

3. The method of claim 1, wherein said ceramic core is comprised of a ceramic material selected from the group consisting of $Al_2O_3$, $B_4C$, and $TiB_2$.

4. The method of claim 1, wherein said powder metal is selected from the group consisting of aluminum alloys, commercially pure titanium, and titanium alloys.

5. The method of claim 4, wherein said powder metal is selected from the group consisting of 6061 aluminum alloy and Ti-6Al-4V.

6. An impact resistant clad composite armor comprising:

a ceramic core; and a layer of metal surrounding said ceramic core and bonded to said ceramic core, said layer of metal being formed by cold isostatically pressing powder metal surrounding said ceramic core to a high initial density followed by vacuum sintering.

7. The impact resistant clad composite armor of claim 6, wherein said ceramic core is comprised of a ceramic material selected from the group consisting of $Al_2O_3$, $B_4C$, and $TiB_2$.

8. The impact resistant clad composite armor of claim 6, wherein said layer of metal is comprised of a metal selected from the group consisting of aluminum alloys, commercially pure titanium, and titanium alloys.

9. The impact resistant clad composite armor of claim 6, wherein said ceramic core is comprised of $TiB_2$ and said layer of metal is comprised of commercially pure titanium or Ti-6Al-4V.

10. An impact resistant clad composite armor comprising:

a ceramic core; and a layer of metal of surrounding said ceramic core and bonded to said ceramic core, said layer of metal being comprised of dense, cold-compacted, sintered powdered metal, said metal being selected from the group consisting of aluminum alloys, commercially pure titanium, and titanium alloys.

11. The impact resistant clad composite armor of claim 10, wherein said layer of metal has approximately 99% full density.

12. The impact resistant clad composite armor of claim 11, wherein said ceramic core is comprised of a ceramic material selected from the group consisting of $Al_2O_3$, $B_4C$, and $TiB_2$.

13. The impact resistant clad composite armor of claim 10, wherein said ceramic core is comprised of $TiB_2$ and said layer of metal consists essentially of commercially pure titanium.

14. The impact resistant clad composite armor of claim 11, wherein said ceramic core is comprised of $TiB_2$ and said layer of metal consists essentially of commercially pure titanium.

15. The impact resistant clad composite armor of claim 10, wherein said ceramic core is comprised of $TiB_2$ and said layer of metal consists essentially of Ti-6Al-4V.

16. The impact resistant clad composite armor of claim 11, wherein said ceramic core is comprised of $TiB_2$ and said layer of metal consists essentially of Ti-6Al-4V.

* * * * *